United States Patent [19]

Leone

[11] Patent Number: 4,655,923

[45] Date of Patent: Apr. 7, 1987

[54] DESILTER APPARATUS INCLUDING ADAPTOR MEMBERS FOR ACCOMMODATING CONNECTION OF CYCLONE SEPARATORS OF ANY DIAMETER TO MANIFOLD CONDUITS HAVING INVARIANT DIAMETERS

[76] Inventor: Vincent D. Leone, P.O. Box 420438, Houston, Tex. 77042

[21] Appl. No.: 737,132

[22] Filed: May 23, 1985

[51] Int. Cl.[4] ..... B04C 5/26

[52] U.S. Cl. ..... 210/512.2; 209/211; 285/177; 285/330; 285/413

[58] Field of Search ..... 209/211; 210/512.1, 210/512.2, 512.3; 285/175, 177, 330, 331, 397, 398, 413, 421

[56] References Cited

U.S. PATENT DOCUMENTS

| | | | |
|---|---|---|---|
| 568,996 | 10/1896 | Totham | 285/330 |
| 2,779,469 | 4/1954 | Harris | 209/211 |
| 2,816,490 | 12/1952 | Boadway et al. | 210/512.1 |
| 2,965,522 | 6/1957 | Crespin et al. | 210/512.2 |
| 3,959,150 | 5/1976 | Frykbulk et al. | 210/512.2 |
| 4,116,477 | 9/1978 | Wahoski | 285/177 |
| 4,148,721 | 4/1979 | Brown et al. | 210/512.2 |
| 4,162,092 | 7/1979 | Hares | 285/177 |
| 4,226,726 | 10/1980 | Rehm | 210/512.2 |
| 4,451,358 | 5/1984 | Chupka | 209/211 |

*Primary Examiner*—John Adee

*Attorney, Agent, or Firm*—Beveridge, DeGrandi & Weilacher

[57] ABSTRACT

An industrial desilter apparatus includes a manifold having inflow and outflow conduits of invariant diameter, a plurality of cyclone separators in communication with the manifold, and one or more adaptor members for connecting the tubular inflow and/or outflow portions of a cyclone separator having any diameter with the corresponding inflow and/or outflow conduits of the manifold. A set of adaptors includes a first singularly-constructed, tubular member for connecting the inflow portion of said cyclone separator having any diameter to the inflow conduit of the manifold and a second singularly-constructed, tubular member for connecting an outflow portion of said cyclone separator having any diameter to the corresponding outflow conduit of the manifold.

17 Claims, 7 Drawing Figures

DESILTER APPARATUS INCLUDING ADAPTOR MEMBERS FOR ACCOMMODATING CONNECTION OF CYCLONE SEPARATORS OF ANY DIAMETER TO MANIFOLD CONDUITS HAVING INVARIANT DIAMETERS

The present invention relates generally to a desilter apparatus. More particularly, the present invention relates to a desilter apparatus including one or more singularly constructed adapting members for enabling free interchange between cyclone separators of any diameter with a standard manifold having conduits of invariant diameters.

BACKGROUND OF THE INVENTION

Hydrocyclone or cyclone separators have experienced an ever increasing use in a variety of industries for an even wider variety of purposes. In the oil industry, drilling fluid is circulated down through the drill pipe, out the drill bit and upwardly back to the surface along the sides of the bore. Circulation of drilling fluid cools the bit while carrying drilled cuttings away from the bit to the surface. Before recirculation of used drilling fluid laden with cuttings down through the bore, the fluid is first circulated through a series of cyclone separators commonly connected in parallel by means of a manifold to form a desilter.

Desilters cleanse the drilling fluid by rapidly circulating the fluid through each cyclone separator. Due to a swirling action of the fluid within the separator, heavier particles such as drill cuttings fall out through a discharge at the bottom of the cyclone, while the cleansed fluid escapes through the top of the cyclone to be recirculated through the drill hole.

It has long been known that the diameter of the cyclone separator regulates the size of the particulate matter which will be expelled through the bottom of the separator. Large diameter cyclone separators discharge large cuttings but allow very fine particles to pass uninhibited through the top of the separator with the drilling fluid. Cleansing the drilling fluid of such fine particles thus require cyclone separators of substantially smaller diameter.

Separators of reduced diameters however are characterized by substantially smaller feed and discharge tubes communicating with interior of the cyclone. Thus up to now, it has been necessary to either change the entire desilter unit or at least the manifold within the unit when cyclone separators of lesser diameters, not accommodated by the manifold, were needed to effect removal of very fine particles.

From U.S. Pat. No. 3,959,150, it is known in the art to provide three pairs of two-piece telescoping connectors for facilitating the quick interchange of cyclone separators in cellulose and paper plants using similarly sized cyclones in each of a plurality of desilter systems. The patentee states that the conventional methods of connecting individual cyclones by hoses and hose clips are time consuming and costly and are further dangerous, due to the potential for hoses to break and thereby release often hot fluid under pressure into the working environment. Although the U.S. Pat. No. 3,959,150 patent adds a set of multielement connectors and sealing members for facilitating quick interchange of cyclone separators having like diameters, a need has remained in the art for a set of single piece adaptor members that permit the free interchange of cyclone separators of any desired diameter with a manifold having conduits of invariant diameters.

SUMMARY OF THE INVENTION

The invention relates to a desilter apparatus including singularly constructed, tubular adaptors for connecting cyclone separators to the manifold, and particularly for connecting cyclone separators of any diameter to a desilter manifold having conduits of standard, invariant diameters. Alternatively, the adaptor elements of the present invention can accommodate the connecting or joining of separators of varying construction to manifolds generally constructed for use with separators of the cyclonic type. The adapting elements further provide means for facilitated substitution of new cyclone separators for worn separators of the same diameter in heavily operated desilter apparatus.

The singularly constructed adaptor members permit free interchange among cyclone separators installed on desilters used in all industries, such as the oil industry or the paper and cellulose industry.

A set of adaptor elements in accordance with the present invention includes a first singularly constructed adaptor for connecting the inflow portion of a cyclone separator of any size to the fluid intake conduit of a standard manifold.

A second adaptor provides communication between the vortex finder portion of the separator and the fluid outflow conduit. Each adaptor element includes radially larger and radially smaller tubular ends, which are integrally or otherwise joined. The radially larger tubular end of the first adaptor abuts with and covers a corresponding tubular end of the manifold supply pipe while the opposing smaller tubular end abuts the tubular inflow portion of the cyclone separator. In like manner, the larger and smaller tubular ends of the second adaptor abut, and cover corresponding larger and smaller tubular end portions of a manifold return branch and the vortex finder of the cyclone separator. Annular recesses near each tubular end provide means for receiving annular flanges extending therein from quick-disconnect, cyclindrical clamping members which are used with the present adaptor element to maintain the abutting engagement of each adaptor element between the branching conduits and the cyclone inflow/outflow portions.

The passageway extending longitudinally through the axial center of each adaptor element, comprises a frusto-conical inner surface section extending approximately through the radially larger tubular end portion to narrow and communicate with a cylindrical inner surface section extending through the remainder of the adaptor element. The communicating conical and cylindrical surfaces regulate the flow of fluid from the manifold inflow conduits into the cyclone separator. Likewise, the communicating surfaces regulate the flow of cleansed fluid out of the separators and back to the manifold outflow conduits.

BRIEF DESCRIPTION OF THE DRAWINGS

These and other aspects and advantages of the present invention are more apparent from the following detailed description and claims, particularly when considered in conjunction with the accompanying drawings in which like parts bear like reference numerals:

DESCRIPTION OF THE PREFERRED EMBODIMENT

Figure 2:
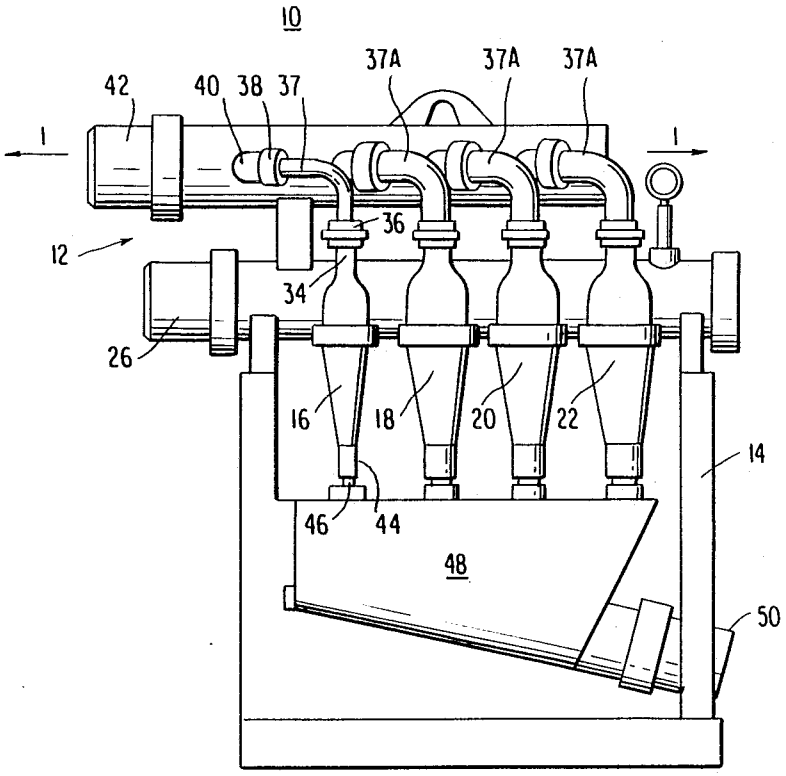
FIG. 2 is vertical cross-sectional side view taken along line 1—1 of FIG. 1.
Figure 1:
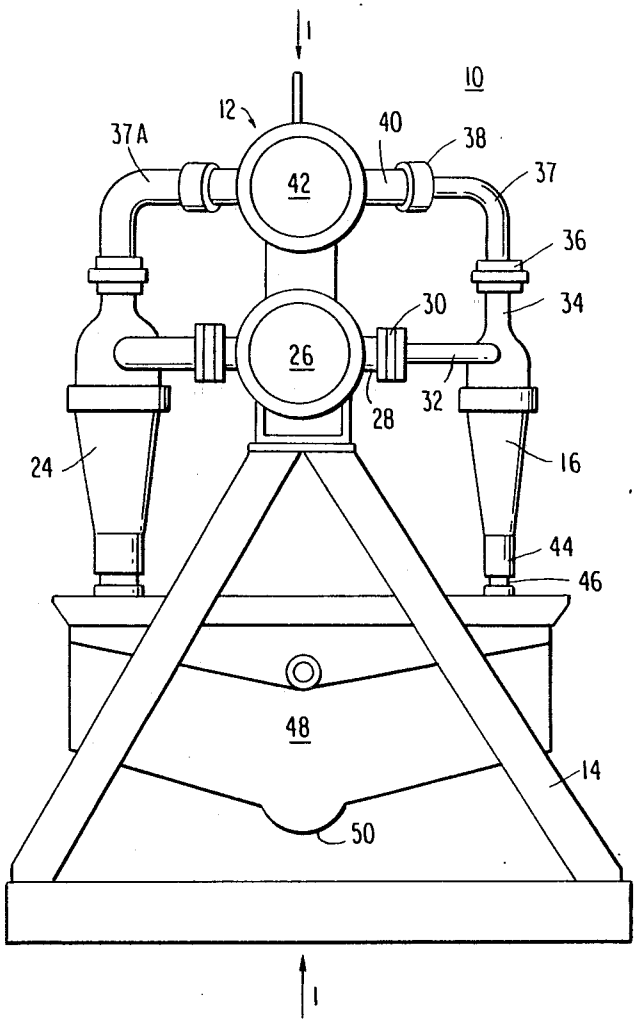
FIG. 1 is a view in front elevation depicting a desilter apparatus incorporated adaptor elements in accordance with the present invention.

In FIGS. 1 and 2, there is shown a desilter apparatus 10 such as that contemplated for use with the set of singularly constructed adaptor members of the present invention. Desilter 10 includes a manifold 12 mounted, in any known way, to frame assembly 14. Cyclone separators 16, 18, 20, 22 and 24 (others not shown) communicate with manifold 12. In the desilter apparatus of FIGS. 1 and 2, cyclone separator 16 is shown as having a diameter smaller than any of separators 18 through 24 depicted as all having larger equivalent diameters.

Throughout the remaining discussion, the preferred desilter apparatus 10 will be described with respect to small diameter cyclone separator 16 which requires use of adaptor members to accommodate its connection with manifold 12. It is to be understood by those skilled in the art that appropriate adaptor elements as will be discussed infra could be used to connect any of the other cyclone separators 18, 20, 22 and 24 to manifold 12 regardless of their diameters.

Inflow conduit 26 communicates with cyclone separator 16 through one of branching supply pipes 28, a first adaptor member 30 hereinafter referred to as cyclone separator inflow adaptor member 30 and tubular separator inflow portion 32. Being of iron or like rigid material, supply pipes 28 have standard, invariant diameters depending upon the particular manifold 12 selected for use in desilter apparatus 10. Cleansed fluid exits cyclone separator 16 at its top portion, or vortex finder 34, and flows through a second adaptor, namely, vortex finder portion adaptor element 36 to small diameter elbow joint 37. From elbow joint 37, the fluid flows through a third adaptor, elbow joint adaptor 38, to one of branching return pipes 40, likewise having invariant diameter. Finally, the fluid flows to outflow conduit 42 of manifold 12. Alternatively, in a manifold not having elbow joints 37 and 37A, such as where branching return pipes 40 communicate directly with separators 16, 18, 20, 22 and 24, only inflow adaptor 30 and vortex finder portion adaptor 36 are needed to adapt the cyclone to the manifold 12.

Discharge ends 44 of the cyclone separators connect through joints 46 to communicate with trough 48 for catching drill cuttings or like particulate matter as the cuttings or like matter, are expelled from each of the cyclone separators. Exhaust conduit 50 conducts waste material collected at trough 48 away from desilter 10. As is evident to those skilled in the art, joints 46 connecting discharge ends 44 with trough 48 may likewise consist of adaptor elements of single piece construction should the diameter of its discharge end vary with the diameter of the cyclone separator installed on desilter apparatus 10.

Figure 3:
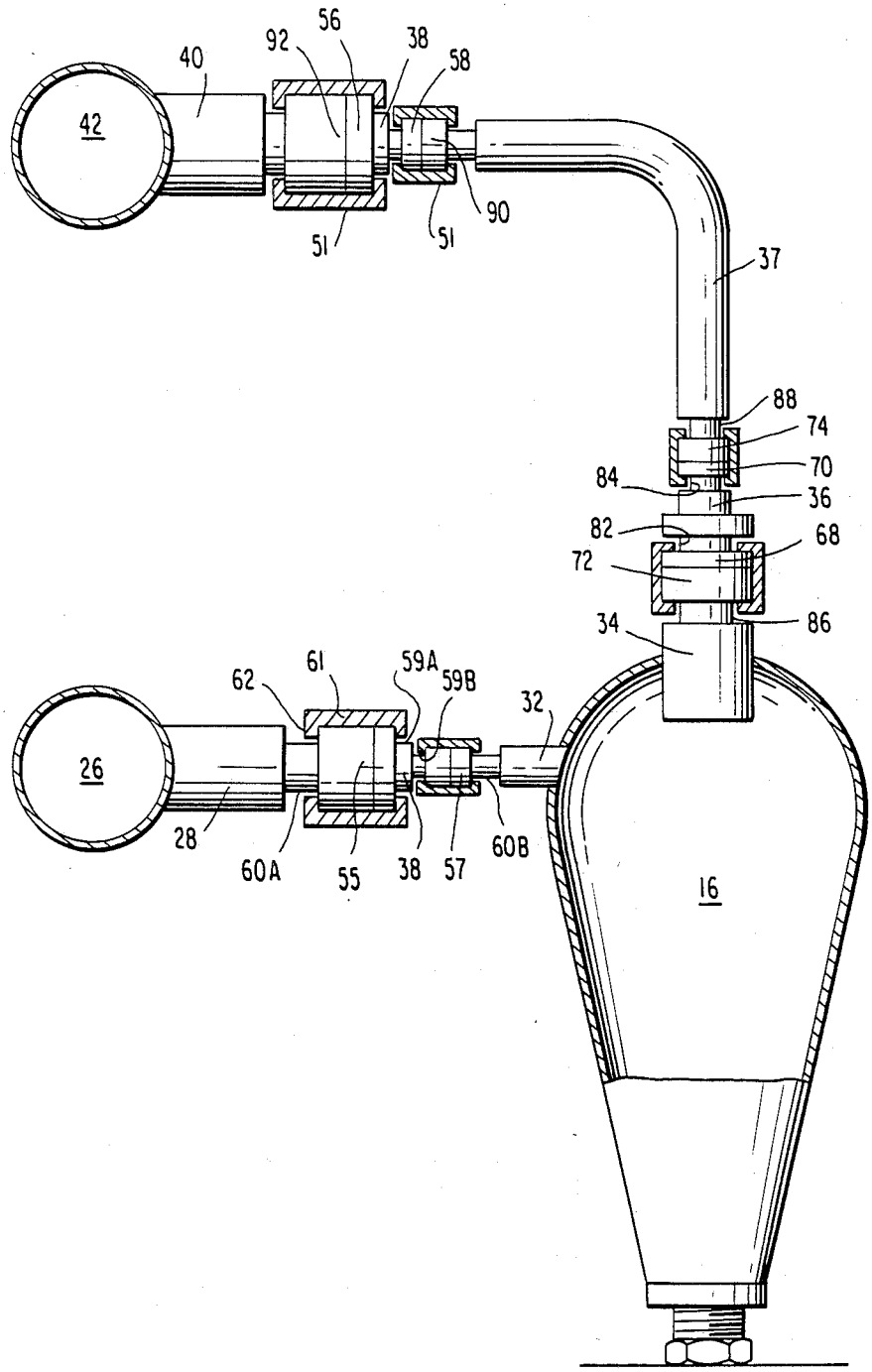
FIG. 3 is an enlarged sectional view of the arrangement shown in FIG. 1 in which is shown in detail the couplings between the adaptor members, the manifold conduits, and the separators inflow/outflow portions.

FIG. 3 illustrates in detail, the communication between conduits 26, 42 and cyclone inflow and outflow portions 32, 34 by a cut-away, sectional view. In the embodiment of FIGS. 1–3, adaptors 30, 36 and 38 are shown as being held in their respective positions between manifold 12 and separator 16 by means of cylindrical locking clamps 51. Clamps 51 are selected to substantially match the diameters of the adaptors, the conduit branches and the cyclone flow end portions. Clamps 51 are well known to the art such as readily available Vitaulic Clamps.

Figure 4:
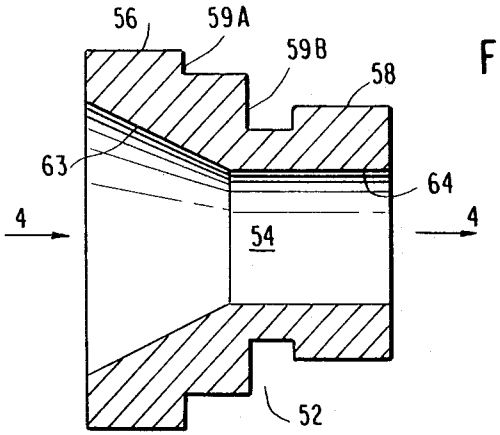
FIG. 4 is a cross-sectional view of a cyclone inlet portion adaptor element suitable for use in the present invention.
Figure 4A:
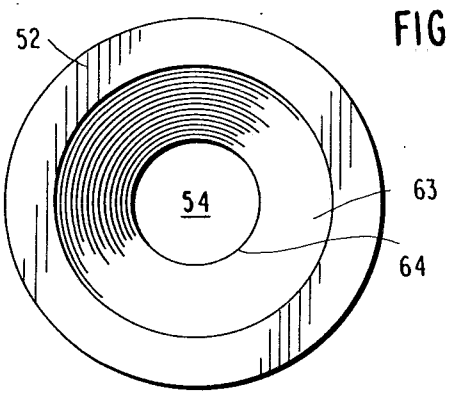
FIG. 4A is a front elevation taken along line 4—4 of FIG. 3.

Inflow adaptor member 30 is seen separately in FIGS. 4 and 4A to include an annular body 52 and a passageway 54 extending longitudinally therethrough. Body 52 includes a larger tubular portion 56 integrally formed with or otherwise unreleasably connected to a smaller tubular portion 58. Tubular portions 56 and 58 are designed to abut respectively against open ends 55 of branching supply pipes 28 and open end 57 of inflow portion 32 as shown in FIG. 3 to provide liquid tight continuity between a supply pipe 28 and inflow portion 32. In the preferred embodiment, body 52 is further provided with annular recesses 59A and 59B by which cylindrical locking clamps 51 such as vitaulic clamps or the like are attached. As seen in FIG. 3, clamps 51 consist of a cylindrical body segment 61 spacing apart a pair of integrally formed annular flanges 62 for extending radially inwardly into recesses 59A, 59B, 60A and 60B. In this way, adaptor 30 is held in communicative abutment between a pipe 28 and inflow portion 32. Cylindrical body 61 wraps tightly around the joint or connection formed by each abutting pair of tubular surfaces to maintain leak-proof fluid communication therebetween. Alternatively, any other clamping means, known to those skilled in the art, may be substituted for cylindrical locking clamps 51.

Passageway 54 extends longitudinally through inflow adaptor member 30 at its axial center. As best seen in FIG. 4, communication between frusto-conical inner section 63 and cylindrical inner section 64 forms passageway 54. Frusto-conical section 63 and cylindrical section 64 meet, in the preferred form, approximately at the point where the larger and smaller tubular portions 56 and 58 meet. However, that the two inner sections meet at exactly this point is not important. In the desilter arrangement of FIGS. 1 and 2, frusto-conical section 63 opens at larger end portion 56 to have a diameter approximating the diameter of open end 55 of any of branching supply pipes 28 while cylindrical section 64 opens at smaller tubular portion 58 to have a diameter approximating that of open end 57. In this way adaptor 30 effects a relatively smooth, non-turbulent transition from the larger diameter supply pipe 28 to the lesser diameter inflow portion 32 for the flow of fluids therebetween. One skilled in the art will appreciate that adaptor 30 can accommodate connection between any cyclone and branching pipes 28, by simply increasing or decreasing the diameter of frusto-conical and cylindrical sections 63, 64 in accordance with the diameters of branches 28 and inflow portion 32.

Figure 5:
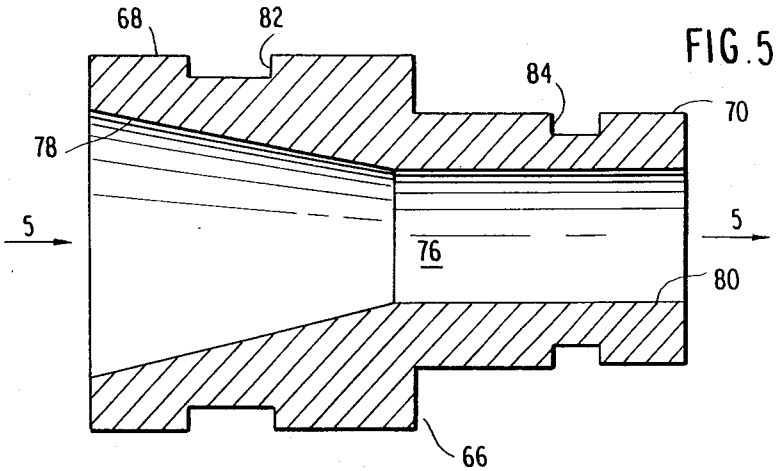
FIG. 5 is a cross-sectional view of a vortex finder adaptor element suitable for use in the present invention.
Figure 5A:
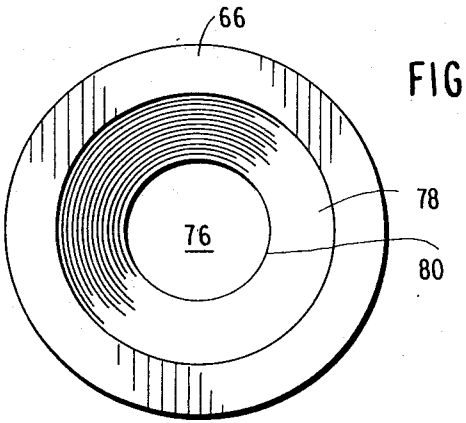
FIG. 5A is a front elevation taken along line 5—5 of FIG. 5.

As shown separately by FIGS. 5 and 5A vortex finder adaptor element 36 has construction similar to that of inflow adaptor element 30. Elongated body 66 being longitudinally longer than body 52 of adaptor 30 likewise has radially larger and smaller tubular end portions 68 and 70. With further reference to FIG. 3, radially larger tubular end portion 68 abuts with, and covers open end 72 of vortex finder 34. Radially smaller end 70 likewise abuts with and covers open end 74 of elbow joint 37, nearest to vortex finder 34 to connect elbow joint 37 with vortex finder 34 and provide a communicative joint therebetween.

Adaptor 36 has a passageway 76 extending longitudinally through the axial center of body 66. Elgonated frusto-conical section 78 extends from its opening at radially larger end 68 to communicate with elongated cylindrical section 80 at a point approximating the meeting point of radially larger and smaller tubular end portions 68 and 70. Passageway 76, including frusto-conical section 78 opening to communicate with open end 72 and cylindrical section opening to communicate with open end 74, facilitates a smooth, non-turbulent fluid flow from vortex 34 having a relatively larger diameter to elbow joint 37 having a relatively smaller diameter.

Elongated body 66 also includes annular recesses 82 and 84 shown as located approximately at the midpoints of each of tubular ends 68 and 70. Flanges 62 of cylindrical locking clamps 51 are likewise received by recesses 82 and 84 in tubular ends 68, 70 and like annular recesses 86 and 88, respectively traversing vortex finder 34 and end 74 of elbow pipe 37. Clamps 51 maintain continuity between cyclone 16 and conduit 42 by holding adaptor 36 in abutment between vortex finder 34 and elbow end 74.

In the adaptor set of FIGS. 1 through 3, elbow joint adaptor 38 is shown as having construction identical to that of inflow adaptor member 30. Thus, elbow joint adaptor 38 is also shown by FIGS. 4 and 4A. As shown in detail by FIG. 3, clamp 51 clamps radially smaller end 58 to end 90 of elbow pipe 37. A second clamp 51, clamps radially larger end 56 to open end 92 of one of branching return pipes 40.

Those skilled in the art will appreciate that depending upon the particular desilter in use, any combination of the disclosed adaptor members 30, 36 and 38 may be selected to effect adaptation of manifold 12 to the desired size cyclone separators. For instance, where the radial extention of the cyclone inflow portion is less than that described in the preferred desilter apparatus 10, adaptor member 30 would comprise an elongated type such as shown in FIGS. 5 and 5A rather than the "shorter" type shown by FIGS. 4 and 4A. In the same sense, where the vortex finder portion of the cyclone separator is elongated, adaptor element 36 would comprise the "short" type adaptor as illustrated by FIGS. 4 and 4A. Thus, it is seen that any combination of the present adaptor as shown by FIGS. 4, 4A, 5 and 5A may be used to adapt any given manifold to the desired size separators.

Alternatively, desilter apparatus in prior use may have undergone structural modifications such as welding of nonstandard size supply branches to the manifold inflow conduits to permanently adapt the manifold inflow conduits to smaller size cyclones. In such a desilter, a single adaptor, for example, vortex finder adaptor 36, may alone be necessary to effect complete adaptation of that manifold to still other lesser diameter cyclones.

Those skilled in the art will further appreciate that the relative positions of the frusto-conical portions and the smaller diameter cylindrical portions would be the reverse of those described hereinabove for installation of a cyclone separator having dimensions larger than those that could be accommodated by manifold 12 without use of the present adaptor elements. Thus, where adapted cyclone 16 had an inflow portion having a greater diameter than those of supply pipes 28, then the cylindrical section 64 of inflow adaptor member 30 rather than the frusto-conical section 62 would communicate directly with supply pipe 28 to promote a non-turbulent fluid flow into the separator.

In some desilter apparatus, elbows 37 and 37 A will be the same size and therefor have identical diameters. Then for installation of smaller cyclones represented by cyclone 16, only inflow and vortex finder adaptor members 30, 36 are required. In such a desilter arrangement, a vortex finder portion adaptor 36 would likewise be oriented reversely from the position described supra. In such a desilter arrangement, larger end 68 would abut and communicate directly with mouth 74 of correspondingly large diameter elbow 37 and smaller end 70 would abut and communicate with vortex finder 34. As hereinbefore discussed, it is again evident that any combination of the adaptor elements shown in FIGS. 4, 4A, 5 and 5A could be used. It is thus seen, that adaptor members 30 and 36 may be used to adapt a conduit such as elbow pipe 37 having any diameter to the desilter of FIG. 1 without regard to the size of cyclone separators used.

By way of example, the desilter of FIGS. 1 and 2 may be modified to cleanse fluid entering its inflow conduit 26 of very fine particulate matter through the use of the present adaptor members. Cyclone separators 18 through 24 and others not shown in the figures also would be removed from desilter 10 and be replaced by like separators having dimensions equal to the of lesser diameter cyclone 16.

In desilter 10, cyclone 16 and all substituted cyclones install on manifold 12 by first positioning inflow adaptor member 30 between a supply pipe 28 and an inflow portion 34. So positioned, frusto-conical section 63 communicates directly with mouth 55 of supply pipe 28 and cylindrical section 64 communicates directly with mouth 57 of inflow portion 32 to provide continuity therebetween. Clamps 51 or any other securing means known to the art are applied to hold adaptor 30 into position. In the preferred form, two clamps 51 correspond to adaptor 30, a first clamp holds adaptor end 56 to pipe 28 while a second clamp having smaller diameter holds end 58 in abutting engagement with inflow portion 32.

Vortex portion adaptor 36 next has its larger tubular end 68 fitted over vortex finder 34 to communicate therewith. Another locking clamp 51 is applied at the joint or connection to hold adaptor 36 in place. Elbow pipe 37, having diameter smaller than either vortex finder 34 or larger end 68 is positioned to abut adaptor end 70, mouth 74 communicating with cylindrical section 80 of passageway 76.

Lastly, elbow adaptor member 38 is positioned to abut, at its smaller tubular end 58, the opposite open end 90 of elbow 37, and at its larger tubular end, branching return 40. Clamps 51 are applied to clamp adaptor 38 in place in precisely the same manner as adaptor 30 is clamped.

Thus, from the foregoing description, it is shown that the adaptors of the present invention provide capability for incorporating cyclone separators of any diameter into a desilter apparatus without need of substituting the entire manifold in order to accommodate cyclones of, for instance, smaller diameter. The capability to interchange cyclone separators of various diameter on the same manifold in turn provide the desilter with the capability to cleanse particulate laden fluid of any size particulate matter. Thus, any desilter designed to accommodate only relatively large diameter cyclone separators capable of separating larger particulate matter can now be modified to remove very fine particles by substituting for small diameter separators with the use of the present adaptor pieces.

Each adaptor piece or member consists of one tubular body element in abutment with both the manifold conduits and the cyclone inflow/outflow tubular portions to produce a reliable liquid-tight connection or joint between such. The single piece construction of each adaptor member provides facilitated, liquid-tight, installation of a cyclone separator to the manifold by simply positioning an adaptor member in abutment with the flow portions of a separator and the corresponding manifold conduit and them clamping such therebetween.

Although the present invention has been described primarily with reference to a preferred embodiment, rearrangements and modifications may be made by one skilled in the art within the scope of the invention and are intended to be encompassed by the claims appended hereto.

What is claimed is:

1. An industrial desilter system comprising:

a manifold having a tubular inflow conduit with branching supply pipes communicatively connected therewith, a tubular cleansed fluid outflow conduit with branching return pipes connected therewith and a solid matter discharge conduit, the branching supply pipes, and the branching return pipes having walls defining invariant fluid-passages;

a plurality of cyclone separators for cleansing fluids, each of said cylcone separators including an inflow portion for connecting with a corresponding branching supply pipe, an outflow portion for connecting with a corresponding branching return pipe and a discharge portion for connecting to the solid matter discharge conduit, said inflow and outflow portions of said cyclone separators defining invariant fluid-passages, at least one of said cyclone separators having an inflow portion with a fluid-passage different from the fluid-passage of the corresponding branching supply pipe, whereby said inflow portion of said at least one separator is not directly connectable to its corresponding supply pipe, and an outflow portion with a fluid-passage different from the fluid-passage of the corresponding branching return pipe, whereby said outflow portion of said at least one separator is not directly connectable to its corresponding return pipe, said different fluid-passages preventing direct fluid-tight connection between said at least one cyclone separator and the corresponding branching pipes of the manifold;

and a set of adaptor members adapting said at least one cyclone separator to connection with its corresponding branching supply and return pipes on the manifold, said adaptor members including at least one first tubular adaptor member, being of singular construction for connecting said at least one separator to its corresponding branching supply pipe, each said first adaptor member having radially larger and radially smaller end portions, one of said end portions having a fluid-passage substantially the same as said fluid-passage of said inflow portion of said at least one cyclone separator and the other of said end portions having a fluid-passage substantially the same as the fluid-passage of the corresponding branching supply pipe for said at least one separator, each said first adaptor member abutting between said inflow portion and the supply pipe, to provide fluid-tight communications therebetween, and at least one second adaptor member, being of singular construction for connecting said outflow portion of said at least one cyclone separator to its corresponding branching return pipe, each said second adaptor member having radially larger and radially smaller end portions, one of said end portions having a fluid-passage substantially the same as said fluid-passage of said outflow portion of said at least one cyclone separator, each said second adaptor member abutting said outflow portion to provide fluid-tight communication between said outflow portion and the return pipe.

2. The desilter system as claimed in claim 1 further including a plurality of elbow joints corresponding to the plurality of branching return pipe, each of the elbow joints having a fluid-passage therethrough and a pair of ends, each said second adaptor member connecting said cleansed fluid outflow portion of said at least one cyclone separator to a first end of its corresponding elbow joint, the other of said ends of each said second adaptor member having a fluid-passage substantially the same as the fluid-passage through its corresponding elbow joint, and a third tubular adaptor member, being of singular construction, for connecting the other end of the corresponding elbow joint to its corresponding branching return pipe, each said third adaptor member having end portions, one of said end portions having a fluid-passage substantially the same as the fluid-passage of its corresponding elbow joint and the other of said end portions having a fluid-passage substantially the same as its corresponding branching return pipe, each said third adaptor member abutting the elbow joint and the return pipe to provide fluid-tight communication between the elbow joint and the return pipe.

3. The desilter system as claimed in claim 2 in which each of said first and third adaptor members has the same longitudinal length and each said second adaptor member is longitudinally longer than said first and third members.

4. The desilter system as claimed in claim 2 in which said fluid-passage of said inflow and outflow portions of said at least one cyclone separator and the fluid-passage of the corresponding elbow joint have diameters being smaller than that which could be accommodated by the manifold in the absence of said adaptor members.

5. The desilter system as claimed in claim 2 wherein the fluid passageway of each adaptor member has a frusto-conical section opening at said tubular end being radially larger and a cylindrical section opening at said tubular end being radially smaller, said frusto-conical section and said cylindrical section communicating at about where said radially larger end and said radially smaller end meet to provide non-turbulent fluid flows therethrough.

6. A set of adaptor members for adapting fluid-tight communicative connection between a desilter apparatus manifold an a cyclone separator, the manifold having a conduit with at least one branching pipe corresponding to said cyclone separator connected thereto, the branching pipe having an invariant fluid-passage, said cyclone separator having a portion for passing fluid between said separator and the at least one branching pipe, said portion having an invariant fluid-passage different from that of the branching pipe whereby said portion of said separator is not directly connectable to its corresponding branching pipe, said adaptor members comprising:

a first singularly constructed, tubular adaptor element for adapting connection of said portion of said separator to its corresponding at least one branching pipe, said adaptor member having a radially larger end portion and a radially smaller end portion, one of said end portions having a fluid-passage substantially the same as said fluid-passage of said portion of said separator and the other of said end portions having a fluid-passage substantially the same as the fluid-passage of the branching pipe whereby when said adaptor member is positioned to abut between said portion and the pipe, said adaptor member provides fluid-tight continuity therebetween.

7. The set of adaptor members as claimed in claim 6 in which of the interior passageway of said tubular adaptor member has a frusto-conical section opening at said tubular end being radially larger and a cylindrical section opening at said tubular end being radially smaller, said frusto-conical section and said cylindrical section communicating at about where said radially larger end and said radially smaller end meet to provide a non-turbulent flow of fluids between said portion of said separator and the branching pipe of the manifold.

8. The adaptor members as claimed in claim 7 in which said second adaptor is relatively longitudinally longer than said first adaptor member, said second adaptor having an elongated tubular body and correspondingly longer passageway therethrough.

9. The set of adaptor members claimed in claim 6 wherein the manifold includes an inflow conduit having at least one branching supply pipe and an outflow conduit having at least one branching return pipe and said cyclone separator has an inflow portion for passing fluid from a corresponding supply pipe to within said separator and an outflow portion for passing fluid from said separator to a corresponding return pipe, said set of adaptor members comprising a first member for abutting between said inflow portion and its corresponding supply pipe and a second member for abutting between said outflow portion and its corresponding return pipe.

10. The set of adaptor members as claimed in claim 9, wherein the desilter apparatus further comprises an elbow connected between a return pipe and said second member, and wherein one of said ends of said second member has a fluid-passage substantially the same as the fluid-passage of the corresponding elbow, said second member abutting between one end of the elbow and said outflow portion, said set of adaptor members comprising a third member for abutting between the other end of the elbow and the corresponding return pipe, one end portion of said third member having a fluid-passage substantially the same as the fluid-passage of the elbow and the other end portion of said third member having a fluid-passage substantially the same as the fluid-passage of the corresponding return pipe.

11. The set of adaptor members as claimed in claim 7 wherein said first and third members have the same longitudinal length and said second member is longitudinally longer than said first and third members.

12. Coupling means for adapting connection between a cyclone separator, including an inflow portion and an outflow portion, and a manifold including an inflow conduit having at least one supply pipe connected thereto and an outflow conduit having at least one return pipe connected thereto, said inflow portion and said at least one supply pipe being unconnectable to provide direct, fluid-tight, communication therebetween and said outflow portion and said at least one return pipe being unconnectable to provide direct, fluid-tight connection therebetween, said supply and return pipes and said separator inflow and outflow portions each having an annular recess therein, said coupling means comprising:

a first adaptor member being of singular tubular construction for abutting said separator inflow portion at one tubular end and said at least one supply pipe at the opposing tubular end to accommodate fluid-tight communication therebetween, said first adaptor member having an annular recess traversing said adaptor at about each of said tubular ends;

a second adaptor member being of singular tubular construction for abutting said cyclone separator outflow portion at one tubular end and said at least one return pipe of said manifold outflow conduit at the opposing tubular end to accommodate fluid-tight communication therebetween, said second adaptor member having an annular recess traversing said adaptor at about each of said tubular ends; and a plurality of cylindrical clamping elements each having spaced apart annular flanges corresponding to one of said recesses in said adaptor members and a like recess in said supply or return pipe of said inflow portion or said outflow portion, said flanges being received by said corresponding recesses to maintain said adaptor in said abutting connection.

13. A modifiable industrial desilter apparatus for removing particulate matter of any size from fluids or air conducted therethrough comprising:

a manifold having a tubular outflow conduit and a tubular inflow conduit, the fluid-passageways of the conduits having invariant diameters, a plurality of cyclone separators each having a corresponding tubular outflow portion and a tubular inflow portion, the fluid-passageways of said portions having invariant diameters different from said fluid-passage diameters of the conduits wherein the cyclone separators are incompatible for direct connection with the manifold conduits, a plurality of adaptor members each being of singular tubular construction, for communicatively connecting at least one of the outflow conduits with a corresponding outflow portion of each cyclone separator and the inflow conduit with a corresponding inflow portion of each separator, said adaptor members enabling free interchange of cyclone separators of any diameter on the manifold, said adaptor members adapting the manifold to accommodate the connection of relatively larger size cyclone separators to enable the removable of relatively large particulate matter from said fluids and the connection of relatively smaller size cyclone separators to enable removal of relatively small particulate matter from said fluids, said desilter thereby providing capability to cleanse fluids or air of particulate matter having any size.

14. An industrial desilter system comprising a manifold having tubular conduits of a first invariant diameter and plurality of cyclone separators having tubular inlets and outlets of a second invariant diameter different from said first diameter whereby the conduits are not directly connectable to said tubular inlets and outlets of said cyclone separator, and a corresponding plurality of adaptor members for connecting at least one of the tubular manifold conduits with a corresponding inlet or outlet of of at least one cyclone separator, each of said adaptor members comprising a singularly constructed tubular body including a first end having a diameter substantially equalling the first diameter of the manifold conduits and a second end having a diameter substantially equalling the second diameter of the corresponding inlet or outlet of the cyclone separator, said at least one adaptor member being adapted for abutting between the manifold conduits and the corresponding separator inlets or outlets, said first end of each adaptor member abutting against and covering a conduit of the manifold and said second end of said each adaptor member abutting against and covering a corresponding inlet or outlet of the separator to effect fluid-passing communication therebetween.

15. The desilter system as claimed in claim 14 in which said tubular adaptor defines a passageway therethrough having a frusto-conical section opening at said tubular end having said first diameter and a cylindrical section opening at said tubular end having a second diameter, said frusto-conical section and said cylindrical section communicating at about the longitudinal center of said tubular body.

16. The desilter system as claimed in claim 15 in which said first diameter is greater than said second diameter.

17. An industrial desilter system comprising a manifold having tubular conduits of a first invariant diameter and a plurality of cyclone separators having tubular inlets and outlets of a second invariant diameter and at least one adaptor member for connecting at least one of the tubular manifold conduits with a corresponding inlet or outlet of a cyclone separator, said adaptor member comprising a singularly constructed tubular body including a first end having a diameter substantially equalling the first diameter of the manifold conduits and a second end having a diameter substantially equalling the second diameter of the corresponding inlet or outlet of the cyclone separator, said at least one adaptor member being adapted for abutting between the manifold conduits and the corresponding separator inlets or outlets, said first end of said at least one adaptor abutting against and covering at least one conduit of the manifold and said second end of said adaptor abutting against and covering a corresponding inlet or outlet of the separator to effect fluid-passing communication therebetween, said tubular adaptor defining a passageway therethrough having a frusto-conical section opening at said tubular end having said first diameter and a cylindrical section opening at said tubular end having a second diameter, said frusto-conical section and said cylindrical section comunicating at about the longitudinal center of said tubular body, said first diameter being greater than said second diameter, said first and second tubular ends each including an annular recess traversing said tubular ends, at least one manifold conduit and one corresponding cyclone separator inflow or outflow portion each including like traversing recesses, said desilter system having at least two cylindrical clamps each having spaced-apart, inwardly extending, annular flanges corresponding to said recesses in said at least one adaptor and said like recesses in at least one conduit and the corresponding inlet or outlet, said flanges being received by said recesses to maintain said at least one adaptor in abutting connection between the conduit and the corresponding inlet or outlet.

* * * * *